United States Patent [19]

Mazzoni

[11] 4,041,663

[45] Aug. 16, 1977

[54] REDUCING SOLAR RADIATION TRANSMITTANCE OF INSTALLED GLAZING

[75] Inventor: Renato J. Mazzoni, Tarentum, Pa.

[73] Assignee: PPG Industries, Inc., Pittsburgh, Pa.

[21] Appl. No.: 710,031

[22] Filed: July 30, 1976

[51] Int. Cl.[2] ..... E06B 3/28

[52] U.S. Cl. ..... 52/203; 52/616; 52/746; 428/428

[58] Field of Search ..... 52/203, 616, 746; 156/107; 428/38, 46, 428

[56] References Cited

U.S. PATENT DOCUMENTS

| | | | |
|---|---|---|---|
| 49,167 | 8/1865 | Stetson | 52/616 X |
| 2,643,020 | 6/1953 | Dalton | 52/616 X |
| 3,296,004 | 1/1967 | Duncan | 106/52 |
| 3,299,591 | 1/1967 | Woelk | 52/616 X |
| 3,343,317 | 9/1967 | Cripe | 52/616 X |
| 3,573,149 | 3/1971 | Tibble et al. | 52/171 X |
| 3,660,061 | 5/1972 | Donley et al. | 428/432 X |
| 3,891,486 | 6/1975 | Willdorf | 156/71 |
| 3,897,580 | 7/1975 | Ingemansson et al. | 428/34 |
| 3,971,178 | 7/1976 | Mazzoni et al. | 52/203 |
| Re. 25,312 | 1/1963 | Duncan et al. | 106/52 |

FOREIGN PATENT DOCUMENTS

| | | | |
|---|---|---|---|
| 1,222,092 | 2/1971 | United Kingdom | 52/616 |

*Primary Examiner*—Alfred C. Perham
*Attorney, Agent, or Firm*—Dennis G. Millman

[57] ABSTRACT

Transmittance of solar radiation (heat and/or light) through a glazing installation is reduced by adhering an additional pane of glass directly onto an installed pane with no airspace therebetween.

11 Claims, 4 Drawing Figures

REDUCING SOLAR RADIATION TRANSMITTANCE OF INSTALLED GLAZING

BACKGROUND OF THE INVENTION

This invention relates to the reduction of solar radiation transmittance through existing glazing installations, more particularly, to the addition of a tinted or coated sheet of glass to an installed window so as to reduce glare and/or total solar energy transmittance.

A great majority of the buildings constructed over the years have been glazed with clear glass. But the popularization of air conditioning together with the rising costs of energy have made it desirable to limit the amount of solar radiation transmitted through glazing installations to amounts less than that transmitted by ordinary clear glass. Thus, in recent years, it has become more common to glaze new construction with glass that has been designed to absorb and/or reflect more radiation than ordinary clear glass, especially radiation in or near the infrared region of the spectrum. But to remove glazing from existing buildings and replace it with all new glass incurs prohibitive expenses in both materials and labor, and is very impractical on tall buildings glazed from the outside.

One currently commercially available means for reducing radiation transmittance through installed glazing takes the form of thin, tinted, plastic films that are applied to the inside surfaces of windows, an example of which may be seen in U.S. Pat. No. 3,891,486 to Willdorf. This approach, however, suffers from numerous drawbacks, chief among which are an appreciable reduction of optical fidelity, insufficient solar energy control, and a susceptibility to scratching which makes cleaning difficult. Air bubbles trapped between the film and the glass can also be troublesome.

The application of an additional pane of glass to an installed pane is not in itself new, such a concept having been shown in at least the following U.S. Pat. Nos.

1,777,432 — C. F. Hogelund
1,915,098 — A. W. Kile
1,945,742 — W. P. Hilger
2,098,127 — W. P. Auger
2,177,001 — W. Owen
2,436,037 — W. A. Doney
2,622,285 — C. J. Roos
2,780,845 — G. G. Lyon
3,299,591 — H. Woelk
3,573,149 — W. J. Tibble et al.

Each of these patents is concerned solely with improving insulating properties by providing a spacer element so as to create an insulating airspace. None deal with the reduction of solar radiation transmittance. Furthermore, none of these patents discloses a sealing arrangement for the enclosed airspace that provides sufficient protection against moisture penetration and condensation in the airspace so as to make permanent architectural installation practical.

SUMMARY OF THE INVENTION

In accordance with the present invention, a tinted (or "colored") or reflectively coated transparent sheet of glass is adhered directly to an installed window pane by means of sealant material applied around the peripheral edges of the added pane so that the panes are in direct, face-to-face contact. No spacer or sealant is interposed between the panes, nor is any desiccant employed. Despite the absence of these elements which are normally considered essential for permanent multiple glazing, the glazing installations of the present invention have been found to be remarkably free from moisture condensation problems. This is apparently attributable to the fact that the installations include essentially no entrapped volume of air from which condensation can take place. Therefore, there is no need for desiccant to keep air dry with the present invention.

Glazing installations in accordance with the present invention effectively control transmission of solar radiation without incurring the special maintenance and durability problems involved in the use of plastic films and without appreciably affecting optical fidelity. Moreover, the use of glass as the solar control pane permits utilization of a wide variety radiation absorbing and/or reflecting agents that are highly effective and can be readily adapted to a wide variety of requirements and conditions.

By reducing the unit thickness to a minimum, the present invention is adaptable to use on window installations having very narrow frames without requiring costly modifications. Although providing considerably better insulation than a single sheet of glass alone, the primary object of the present invention is the reduction of solar radiation transmittance. Although not limited to such, it is contemplated that the invention will have maximum applicability in regions having mild climates, where the reduction of air conditioning costs is of greater concern than heating costs. The present invention provides an economical answer to this need by eliminating the cost of a spacer element and desiccant, thus providing permanent, maximum exclusion of solar energy while holding installation costs to a minimum.

BRIEF DESCRIPTION OF THE DRAWINGS

Each of the figures shows a vertical cross-section through a typical single glazed building window with a solar control pane added thereto in accordance with one of the various embodiments of the present invention.

DETAILED DESCRIPTION

Figure 1:
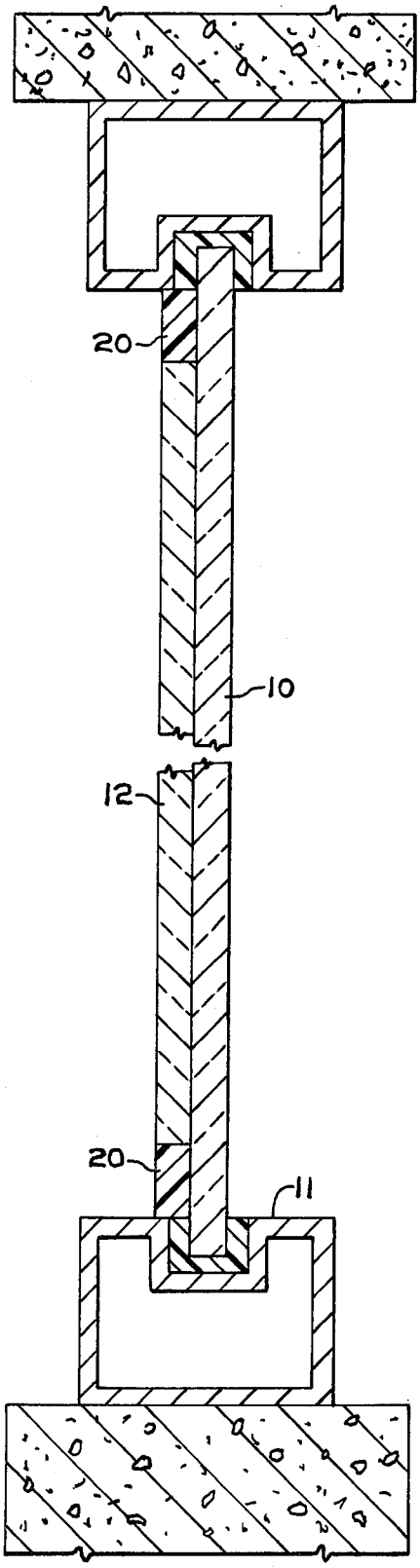
FIG. 1 shows the basic embodiment of the invention.

Depicted in the figures is a window opening within a building wall structure originally glazed with a single transparent pane 10 in a frame 11. Installed pane 10 in most cases will be clear glass, typically having a visible light transmittance of about 90 percent, although the invention is also adaptable to further reducing the solar radiation transmittance of installed windows which already include tinted or coated panes. Instead of single pane 10, the installed window could include multiple glazing having two or more spaced panes. The configuration of the frame 11 shown in the drawings is merely schematic and could have almost any of the great variety of forms that are encountered in building structures.

The desired reduction in heat and light transmittance is achieved by mounting an additional pane 12 of tinted or reflectively coated glass onto installed pane 10 with direct, face-to-face contact between the opposed major glass surfaces. The additional pane 12 may be applied to either the indoor or outdoor side of the installed pane.

When a surface of the additional pane is reflectively coated, better reflectance of solar radiation is obtained if the additional pane is mounted on the outside. On the other hand, mounting on the indoor side spares the additional pane and the means used to seal the airspace 13 from the ravages of weather exposure. On multi-floored buildings, installation from the indoor side is usually preferred because of easier accessibility.

Tinted (or colored) glass for use in connection with the present invention includes any glass whose composition differs from that of clear glass so as to absorb a greater proportion of incident visible light (luminous) radiation and/or total solar energy (especially heat or infrared radiation). For example, the addition of minor amounts of iron oxide to the composition of standard soda-lime-silica glass is known to yield a product having a greenish tint. Other suitable tinted glasses are disclosed in U.S. Pat. Nos. 3,296,004 and No. Re. 25,312, the disclosures of which are hereby incorporated by reference.

The reflectively coated glass employed as the additional pane incorporates on a surface of the glass a transparent coating which has the property of reflecting incident light and/or heat radiation. Examples of suitable reflective coatings for glass may be found in the following U.S. Pat. Nos.: 3,185,586; 3,410,710; 3,411,934; 3,457,138; 3,652,246; 3,660,061; 3,671,291; 3,672,939; 3,674,517; 3,723,158; and 3,723,155, the disclosures of which are incorporated herein by reference. Other reflective coatings for glass as are known in the art are also suitable for use with the present invention. In some cases, it may be desirable to use glass that is both tinted and coated.

In general, the tinted and/or coated additional panes used in connection with the present invention preferably have a visible light transmittance of no more than about 75 percent. Alternatively, the additional pane may be provided with a total solar energy transmittance of less than about 70 percent. Preferably, both of the above transmittance criteria will be met by the glass employed for the additional pane, but only one need be met to obtain at least some of the benefits of the present invention. One specific embodiment that meets both transmittance criteria is ⅛ thick glass reflectively coated in accordance with U.S. Pat. No. 3,660,061.

Since the added pane 12 bears against installed pane 10, strength requirements for the added pane are minimal. Therefore, additional economies may be obtained by selecting the thinnest glass available for the added pane. Typically, glass having thicknesses on the order of 3/32 inch (2 millimeters) to ¼ inch (6 millimeters) are employed for window glazing and would be suitable for the add-on pane.

It should be understood that although the present invention is said to involve no airspace between the panes, there may be some very small amounts of air which unavoidably become entrapped between the panes. This may be caused, for example, by undulations in the glass surfaces which prevent the surfaces from lying perfectly parallel to each other. It may also be possible that a submicroscopic film of air persists between panes that are pressed together even when their surfaces are essentially perfectly planar. Thermal expansion of these small amounts of entrapped gas occasionally may even tend to cause a slight bowing of the glass and a small separation between the panes in the center of the vision area. The expressions "no airspace" and "in direct contact" as used herein are intended to encompass those situations where minor amounts of air may be incidentally trapped between the panes.

As can be seen in the drawings, added pane 12 is cut slightly smaller than the existing window frame opening so as to leave a marginal portion of installed pane 10 exposed around the entire periphery. The channel thus formed provides a site for applying sealant to make a glass-to-glass bond between the panes. The width of the channel should be great enough to expose sufficient surface area on the installed pane 10 to enable the formation of a good structural bond and a moisture resistant seal therewith. On the other hand, the channel should not be wider than necessary since an excess would unduly reduce the vision area and may be aesthetically undesirable. A channel width of about 1/16 inch (about 2 millimeters) has been found suitable for some installations, but widths smaller or larger may be permitted or required, depending on various factors such as the size of the window, type of sealant, technique used to apply sealant, and personal taste. It should be noted that it is advantageous to seal the added pane directly to the installed glass rather than to the frame member 11 since existing window frame structures are seldom moisture-tight and the smooth glass surface is easy to prepare for bonding.

Referring now to FIG. 1 in particular, a body of sealant 20 is shown in the peripheral channel, which adheres panes 10 and 12 together and seals the interface between the panes. The sealant is shown as filling the entire channel in FIG. 1, but it should be understood that it is necessary only that the sealant form a continuous web from the peripheral edge surfaces of the added pane 12 onto a portion of the exposed marginal surfaces of installed pane 10 around the periphery of the installation. The sealant may be extruded into the channel, or it may be supplied in tape or string form which can be pressed into place.

The choice of suitable sealants is quite broad, extending to virtually the entire range of compounds known as sealants and caulks, including, for example, the well-known butyl, polysulfide, "hot-melt," and silicone types. The most important requirement is that the sealant be capable of being applied in a deformable, tacky condition. Moisture vapor transmittance requirements may be relaxed somewhat for many installations of the present invention compared to the requirements for conventional double glazed units. Also, the presence of volatile components in some sealants is less of a drawback with the present invention than with units that include airspaces. In embodiments like that shown in FIG. 1, it is preferred that sealant 20 be of a type that sets up to form a structural bond which remains fairly rigid at elevated temperatures, since it alone is responsible for the integrity of the installation. By carefully selecting their constituents, most types of sealants and caulks can be provided with specific formulations which have enhanced rigidity when cured and minimized thermoplasticity, but common silicone caulking compounds in particular have been found to be conveniently suitable for use in the present invention in their commercially available form. A specific silicone caulk with which the invention has been practiced is made by the Dow-Corning Corporation, Midland, Mich. and is identified as "781 Building Sealant." This commercial product is a partially uncured silicone rubber with an acidic curing agent which is activated upon contact with atmospheric moisture. Curing is effected in about 24 hours, whereupon the cured sealant exhibits a Shore A Durometer hardness of 25 (ASTM D2240), tensile strength of 250 psi (ASTM D412), peel strength of 20 lbs/inch (Mil-S-8802C), and tear strength of 20 lbs/inch (ASTM D2240, die B), all measured after 7 days at 77° F. (25° C.).

Because the sealant is applied in an uncured, softened state, it is advisable that the added pane 12 be held in place within the existing window opening until the sealant sets up sufficiently. This involves placing setting blocks (usually small pieces of plastic or rubber) under the lower edge of the added pane at the quarter points as is customary in glazing practice. The setting blocks may be left in place and sealed over, or they may be removed when the sealant has at least partially set up and the gaps they leave filled with sealant. The added pane may be temporarily restrained against horizontal movement while the sealant is uncured by means of braces or clips attached to the frame or wall, or in some cases by means of nails or the like driven into the frame.

While the silicone caulks and other types of rigid-curing sealants provide an adequate barrier against moisture penetration between the panes for many applications of the present invention, their resistance to moisture vapor transmittance is typically interior to that of some of the other classes of sealants, especially the butyl-based sealants. Thus, the alternate embodiment shown in FIG. 2, wherein a composite of a relatively rigid sealant 21 such as a silicone caulk and a more deformable but highly moisture-resistant sealant 22 are employed, increases the reliability of the moisture seal and permits installation in locations with more severe climate conditions. It is preferred to apply the more rigid sealant first in order to form an intact structure as soon as possible, and then apply the softer moisture barrier over the first sealant after the first sealant has at least partially cured, but the reverse order of application would also be feasible. A suitable butyl-based sealant with a very low moisture vapor transmittance which may be used in conjunction with a more rigid bonding sealant is the two-component room temperature setting sealant disclosed in U.S. Pat. No. 3,791,910 to G. H. Bowser, the disclosure of which is incorporated herein by reference.

Figure 2:
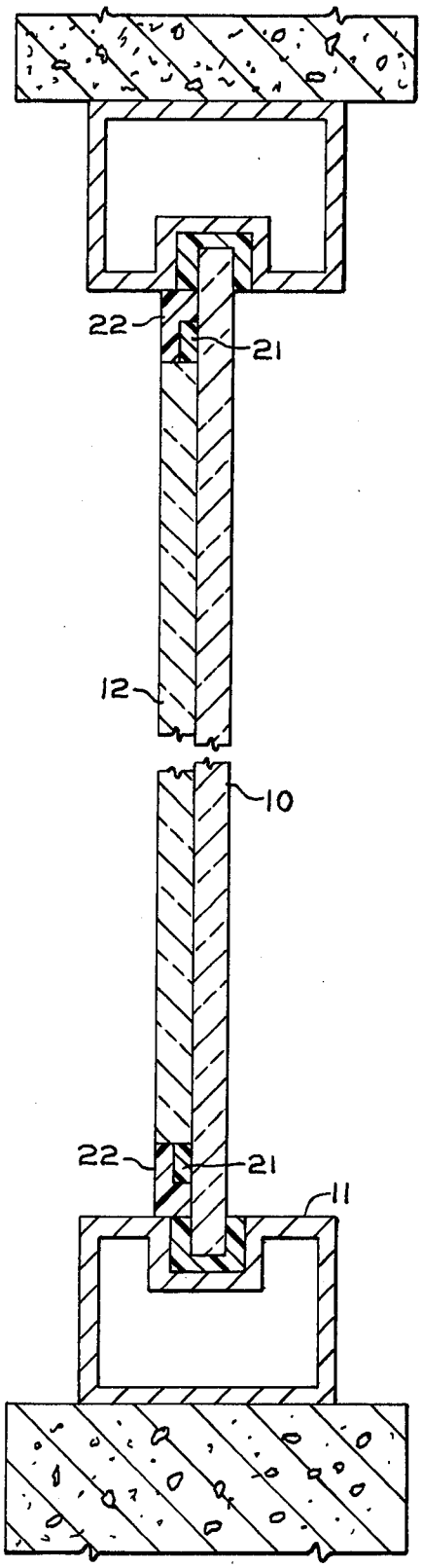
FIG. 2 shows an alternate embodiment having a composite sealing arrangement using two types of sealant.
Figure 3:
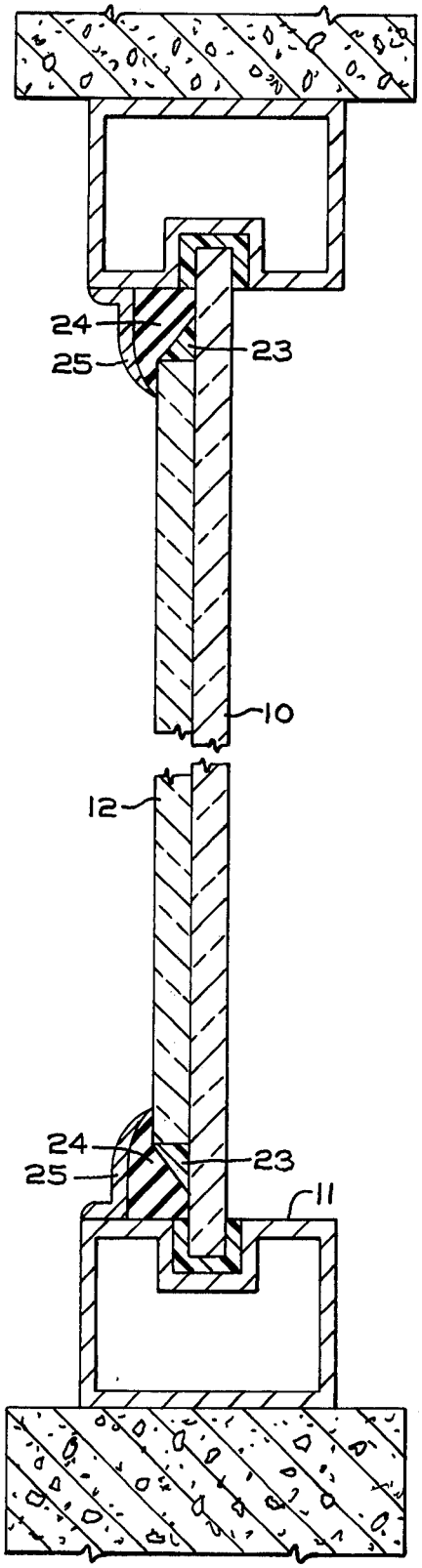
FIG. 3 shows a modified composite sealing arrangement with a trim strip in place.

FIG. 3 depicts a variation of the composite sealing arrangement of FIG. 2, wherein a relatively rigid caulk 23 is covered with a more impervious sealant 24 which extends onto the exposed major surface of added pane 12. Such an arrangement provides larger surfaces onto which the sealants may be applied. A decorative molding 25 may be affixed around the periphery of the installation by means of sealant 24. The molding may also serve the function of protecting a soft, non-curing sealant which may be used as sealant 24. An example of such a non-curing sealant is the following composition:

| Ingredient | Percent by Weight |
|---|---|
| polyisobutylene (viscosity average molecular weight 81,000 to 99,000) | 19.2 |
| polyisobutylene (viscosity average molecular weight 8,700 to 10,000) | 16 |
| polybutene (number average molecular weight 1400) | 27.8 |
| carbon black | 14.1 |
| zinc oxide | 2.8 |
| silica pigment ("HI-SIL 233") | 8.8 |
| silica pigment ("SILINOX 101") | 2.1 |

-continued

| Ingredient | Percent by Weight |
|---|---|
| zirconium orthosilicate | 8.8 |
| gamma-glycidoxypropyltrimethoxysilane | 0.4 |

Figure 4:
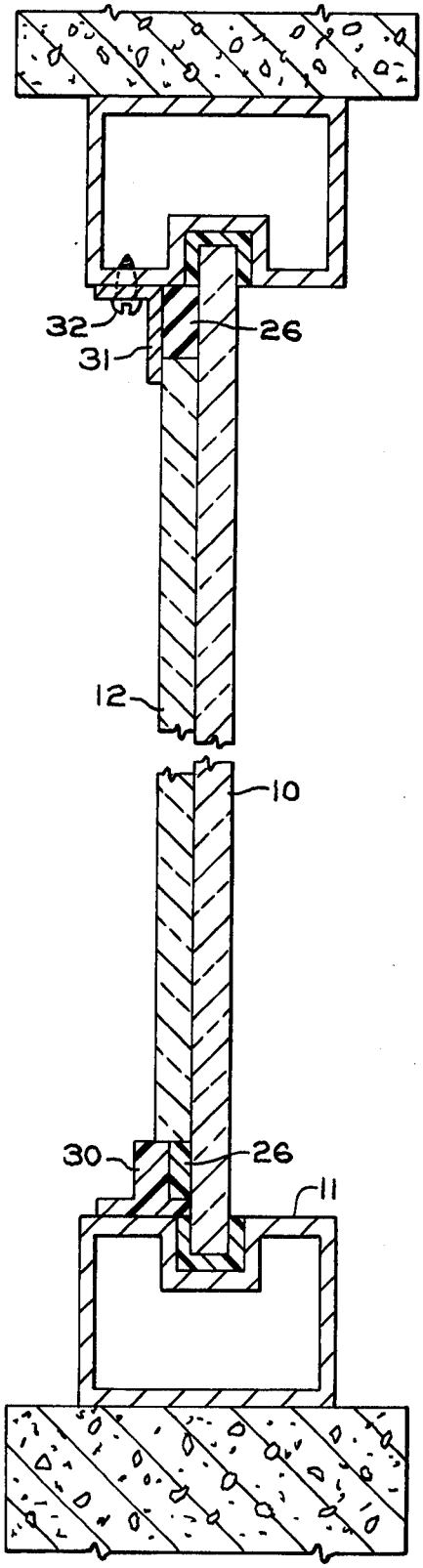
FIG. 4 shows yet another embodiment, wherein auxiliary mechanical retainer means are employed.

FIG. 4 shows an embodiment which permits use of a single sealant 26 which may be somewhat soft or thermoplastic in nature. Auxiliary mechanical retaining means, rather than the sealant alone, are relied upon to maintain structural integrity of the completed assembly. Added pane 12 rests on setting blocks 30 (at least two are employed) which may be spaced from pane 10 so that sealant may be forced behind the setting blocks. Alternately, the setting blocks may be notched as shown in FIG. 4 to form a space into which sealant may be forced. The setting blocks are left in place permanently. A plurality of clips 31, which are fastened to the window frame such as by means of screws 32, are employed along the upper edge of the unit, and preferably along the sides as well, to prevent horizontal dislocation of the added pane. Alternately, clips 31 may take the form of a continuous molding strip which may be decorative as well as functional.

It is to be understood that other variations and modifications as are known to those of skill in the art may be resorted to without departing from the spirit and scope of the invention as defined by the appended claims.

I claim:

1. A reglazed window installation having reduced solar radiation transmittance comprising:

a building wall structure;

frame means connected to said building wall structure and outlining a vision opening, said frame means including a pane-edge-receiving channel;

an installed glazing unit which includes at least one transparent pane, said channel engaging edge portions of said glazing unit so as to retain said glazing unit in said vision opening;

an added transparent glass pane having height and width less than that of said vision opening and lying parallel to and in direct contact with a major glass surface on the exterior of said glazing unit, with the peripheral edges of said added pane spaced from said frame means, said added pane having visible light transmittance of no more than about 75 percent;

sealant disposed between the peripheral edges of said added pane and said frame means, said sealant being adhered to said added pane and to the adjacent surface of said glazing unit so as to provide adhesion and a moisture resistant seal therebetween.

2. The reglazed installation of claim 1 wherein said installed glazing unit consists of a single pane of glass.

3. The reglazed installation of claim 1 wherein said installed glazing unit consists of a multiple glazed unit which includes two spaced-apart panes of glass and an enclosed airspace therebetween, said exterior surface with which said added pane is in contact being outside said airspace.

4. The reglazed installation of claim 1 wherein said added pane is comprised of tinted glass.

5. The reglazed installation of claim 4 wherein said added pane includes a transparent reflective coating on at least one major surface.

6. The reglazed installation of claim 1 wherein said added pane includes a transparent reflective coating on at least one major surface.

7. The reglazed installation of claim 1, further including setting blocks interposed between the lower edge of said added pane and the frame means, and means for preventing horizontal displacement of the added pane affixed to said frame means and engaging said added pane.

8. The reglazed installation of claim 1 wherein said sealant comprises two discrete layers of differing composition, one composition having less rigidity and a lower rate of moisture vapor transmittance than the other composition.

9. The reglazed installation of claim 1, further including trim adhered around the added pane by means of said sealant.

10. The reglazed unit of claim 1 wherein the added pane has a total solar energy transmittance of less than about 70 percent.

11. A method of reducing solar radiation transmittance through installed window glazing comprising the steps of:

providing at the site of an installed, framed window previously mounted in a building wall structure, an additional pane of glass having visible light transmittance of no more than about 75 percent;

aligning said additional pane inside the outline of the frame of said installed window, in generally parallel, overlying relation to a major surface of a pane of said installed window, and urging said additional pane into direct, face-to-face contact with said major surface of the installed pane; and while said direct, face-to-face contact is maintained, applying a sealant material around the perimeter of said additional pane so as to seal the interface between said panes.

* * * * *